US006798437B2

(12) United States Patent
Seibert

(10) Patent No.: US 6,798,437 B2
(45) Date of Patent: Sep. 28, 2004

(54) IMAGING OF PRINTING FORMS USING A LASER DIODE BAR WHICH ALSO INCLUDES NON-ACTIVATABLE LASER DIODES

(75) Inventor: Claus Seibert, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 18 days.

(21) Appl. No.: 10/392,585

(22) Filed: Mar. 20, 2003

(65) Prior Publication Data

US 2003/0179278 A1 Sep. 25, 2003

(30) Foreign Application Priority Data

Mar. 21, 2002 (DE) ..... 102 12 532

(51) Int. Cl.[7] ..... B41J 2/435; B41J 2/47
(52) U.S. Cl. ..... 347/234; 347/248
(58) Field of Search ..... 347/234, 242, 347/248, 253, 257

(56) References Cited

U.S. PATENT DOCUMENTS 5,717,451 A * 2/1998 Katano et al. ..... 347/242
6,181,362 B1 1/2001 Laberge ..... 347/233
6,252,622 B1 6/2001 Laberge ..... 347/238

FOREIGN PATENT DOCUMENTS

DE 10131915 1/2002

* cited by examiner

*Primary Examiner*—Hai Pham
(74) *Attorney, Agent, or Firm*—Davidson, Davidson & Kappel, LLC

(57) ABSTRACT

Described is a method for imaging a printing form (10) using one or more laser diode bars having a number n of individually controllable laser diodes (16) whose imaging spots (20) lie essentially in a row on the printing form (10), for the case that at least one laser diode (16) on the laser diode bar (14) cannot be activated, but a maximum number m of laser diodes (16) whose neighboring imaging spots (20) have a distance a on the printing form (10) are able to be activated. The relative speed between the imaging device (12) and the printing form (10) is increased by the factor (n/m). The exposure time per printing dot (69) is shortened by the factor (m/n). In order to input in each case an amount of energy per printing dot (69) on the printing form (10), imaging is carried out using the m activatable laser diodes (16) with an imaging intensity which is a function of the exposure time and of the specific amount of energy per printing dot (69).

15 Claims, 3 Drawing Sheets

IMAGING OF PRINTING FORMS USING A LASER DIODE BAR WHICH ALSO INCLUDES NON-ACTIVATABLE LASER DIODES

Priority to German Patent Application No. 102 12 532.5, filed Mar. 21, 2002 and hereby incorporated by reference herein, is claimed.

BACKGROUND INFORMATION

The present invention relates to a method for imaging a printing form, using an imaging device containing a laser diode bar which has a number n of individually controllable laser diodes, the imaging spots of the activated laser diodes lying essentially in a row on the printing form, for the case that at least one laser diode on the laser diode bar cannot be activated and that the laser diode bar has a maximum number m of activatable laser diodes whose neighboring imaging spots on the printing form have a distance a. The present invention further relates to a method for imaging a printing form using a number b of imaging devices which each contain a laser diode bar having a number n of individually controllable laser diodes, the imaging spots of the activated laser diodes of the number b of imaging devices lying essentially in a row on the printing form, for the case that at least one laser diode on one of the b laser diode bars cannot be activated and that all laser diode bars have a number m of activatable laser diodes whose neighboring imaging spots on the printing form have a distance a.

In printing form imaging units or printing units of printing presses featuring imaging devices (so-called "direct imaging printing units"), frequently, several imaging beams, in particular generated by laser diodes, are used concurrently to efficiently reduce the imaging time for the imaging of the two-dimensional surface of the printing form. If a non-redundant imaging method is used, that is, if the imaging beams are moved over the two-dimensional surface of the printing form in such a manner that the location of each printing dot to be placed is passed over by an imaging beam exactly once, the imaging time for the total surface to be imaged using an imaging device having n imaging beams is reduced to (1/n) of the time. Further shortening can be achieved in an equally efficient manner by parallel use of b imaging devices which each image sections of the printing form in a non-redundant manner, analogously to the above-described procedure. Then, the imaging time for the total surface to be imaged is reduced to (1/b) of the time; to be more precise, using b imaging devices having n imaging beams to (1/(bn)) of the time.

Thus, the substantial shortening of the imaging time by non-redundant parallelization strongly depends on the number of available (activatable) or used imaging beams, since, without parallelization, the imaging time for the total surface to be imaged is equal to the number of all printing dots to be placed multiplied by the exposure time thereof, to be more precise, multiplied by the maximum available time for imaging one printing dot when passing over the locations of the surface in a non-redundant manner. Non-redundancy may be desirable not only because of these time considerations but also for reasons of mounting space or cost.

In order to pass a number of imaging beams (independently of whether they are arranged on one or on several imaging devices) over the locations of a two-dimensional surface of a printing form on which printing dots are to be placed, it is required to observe certain feed rules for the passage of locations that are imaged in a preceding step with respect to locations that are imaged in a subsequent step. These feed rules must be strictly complied with, especially if in an imaging step, n imaging beams place n printing dots at locations which do not lie densely together on the printing form, i.e., whose distance is not the minimum printing dot spacing p (typically 10 micrometers). In order to achieve a dense imaging, printing dots are placed between already imaged printing dots in a subsequent imaging step. This procedure is also known by the term "interleaving method" (interleaving). An interleaving method for imaging printing forms is characterized, for example, in German Patent Application No. DE 100 31 915 A1: Given a minimum printing dot spacing p, for a number of n imaging channels on a setting line, which are equally spaced from each other and whose neighboring imaging spots on the printing form have a distance a which is a multiple of the minimum printing dot spacing p, a non-redundant feed by the distance (np) in the direction of the setting line is guaranteed if the natural numbers n and (a/p) are relatively prime.

The implementation of a non-redundant interleaving method according to DE 100 31 915 A1 critically depends on that n equally spaced imaging beams are available, i.e., activatable, on a setting line. The strategy proposed in this document in case of failure or inoperability of an imaging beam is to use the largest, still connected section of the equally spaced imaging channels if the intention is to avoid non-imaged strips on the printing form and to ensure a constant imaging quality. It is clear that, for implementing a non-redundant interleaving method according to this document, it is required to choose a number of imaging beams of the still connected section that is relatively prime to the multiple distance (a/p). Pursuant to this strategy, failures or inoperabilities of further imaging channels result in only very short sections of the originally n parallel imaging beams. Consequently, the imaging time considerably increases with the decrease of parallelization still available. For example, in the worst case that in each case one imaging beam in the middle of the largest connected section on the setting line fails, the imaging time is in each case increased to the double, that is, for several failures, to a multiple of the original parallelized imaging time. In practice, this is completely unacceptable.

When using laser diode bars in imaging devices, failure or inoperability of a laser diode is generally particularly critical if each imaging beam is generated by exactly one laser diode, because in order to restore the original performance, it is necessary to replace the whole laser diode bar. For economic reasons alone, this is not sensible since the other laser diodes on the bar are generally still functional, that is, the laser diode bar has not become completely inoperable.

In U.S. Pat. No. 6,181,362 B1, it is proposed to assign each imaging beam two laser diodes on a laser diode bar. To image a printing form, one laser diode is used per imaging beam. If the first laser diode fails, the second laser diode is used instead. However, the document leaves open how to proceed if the redundant laser diodes for generating the imaging beam fail at the same time.

As an alternative to this, U.S. Pat. No. 6,252,622 B1 proposes to assign each imaging beam a first laser diode on a first laser diode bar and a second laser diode on a second laser diode bar. To image a printing form, one laser diode of one of the two laser diode bars is used per imaging beam. If the first laser diode on the first laser diode bar in one imaging channel fails, the second laser diode on the second laser diode bar is used instead. However, the document leaves open how to proceed if the redundant laser diodes for generating the imaging beam fail at the same time.

The design approaches of U.S. Pat. No. 6,181,362 B1 and U.S. Pat. No. 6,252,622 B1 have in common that, roughly speaking, for the generation of each imaging beam, simply a replacement laser diode is kept available in case of inoperability. In consequence, this is cost-intensive. To guarantee a reliable strategy, double the number of laser diodes are required right from the beginning. In practice, many of the replacement diodes are a priori not needed at all. Both documents fail to provide a fundamental solution to the problem of how to proceed in case of a failure of one imaging beam or of several imaging beams.

SUMMARY OF THE INVENTION

An object of the present invention is to carry out a fast imaging of a printing form using an imaging device which contains a laser diode bar having n laser diodes of which one or more laser diodes have failed.

The present invention provides a method for imaging a printing form (10), using an imaging device (12) containing a laser diode bar (14) which has a number n of individually controllable laser diodes (16), the imaging spots (20) of the activated laser diodes (16) lying essentially in a row on the printing form (10), for the case that at least one laser diode (16) on the laser diode bar (14) cannot be activated and that the laser diode bar (14) has a maximum number m of activatable laser diodes (16) whose neighboring imaging spots (20) on the printing form (10) have a distance a. The method is characterized by the following steps:

increasing the relative speed between the imaging device and the printing form by the factor f, where $f>1$ and $f \leqq n$ and f is an element of the set of real numbers;

shortening the exposure time per printing dot (69) by the factor 1/f; and imaging using the m activatable laser diodes (16) with an imaging intensity which is a function of the exposure time and of the specific amount of energy per printing dot (69) in order to input in each case an amount of energy per printing dot (69) on the printing form (10).

For the practical implementation of the imaging of a printing form, in particular an offset printing form, it is desirable that, independently of the above-described parallelization by using as large a number of imaging beams as possible, whether on one or more imaging devices, the imaging time for the total printing form surface to be imaged does not change substantially, preferably not at all, in case of a reduction of the number of concurrently available imaging beams. This is true especially when the intention is to concurrently image several, typically four or eight printing forms in four or eight printing units in a printing press so that waiting for the completion of the imaging having the lowest degree of parallelization would extend the imaging process in a completely unacceptable manner.

According to the present invention, therefore, in the method for imaging a printing form, using an imaging device which contains a laser diode bar having a number n of individually controllable laser diodes, the imaging spots of the activated laser diodes lying essentially in a row on the printing form, for the case that at least one laser diode on the laser diode bar cannot be activated and that the laser diode bar has a maximum number m of activatable laser diodes whose neighboring imaging spots on the printing form have a distance a, in other words, which have an equal distance a, at least the following steps are carried out: The relative speed between the imaging device and the printing form is increased by a factor f ($f>1$, f is an element of the set of real numbers, $f \leqq n$), preferably by the factor (n/m). The exposure time per printing dot is shortened by a factor 1/f, preferably (m/n). In order to input in each case an amount of energy per printing dot on the printing form, imaging is carried out using the m activatable laser diodes with an imaging intensity which is a function of the exposure time and of the specific amount of energy per printing dot.

The equal distance a of the imaging spots of activatable laser diodes on the printing form can be achieved by suitable imaging optics or by triggering the laser diodes in a time-staggered manner. It is particularly advantageous if the laser diodes are already evenly arranged on the laser diode bar and imaged onto the surface of the printing form, possibly with a magnification or reduction factor.

The relative speed can be produced by moving the imaging device with respect to the printing form, by moving the printing form with respect to the imaging device, or by moving both. In particular, a movement in a direction developing the surface of the printing form into a plane can be accomplished by moving the printing form, and a movement in a direction that is linearly independent with respect to the mentioned direction can be accomplished by moving the imaging device. In this connection, it should also be noted that the movement can be discontinuous or continuous. Preferably, the movement is continuous and uniform.

Since, when passing over the locations of the surface in a non-redundant manner, the imaging time for the total surface to be imaged without parallelization is equal to the number of all printing dots to be placed times the exposure time thereof, the following beneficial consequence arises in the method according to the present invention. As described in detail above, a parallelization using an imaging device having n imaging beams reduces the imaging time to (1/n) of the time. If now, only $m<n$ imaging beams are available, imaging would be carried out only in (1/m) of the time, which is longer than (1/n) of the time, if the imaging conditions are maintained. However, by increasing the relative speed and, conversely, shortening the exposure time per printing dot, it is advantageously achieved that the total surface to be imaged is already imaged in (1/n) of the time. Now, the passage of the m imaging beams over the surface is carried out f times, in particular, (n/m) times faster than a passage of n imaging beams so that only an exposure time which is reduced by the factor 1/f, in particular by the factor (m/n) compared to the parallel imaging using n imaging beams is available per printing dot. However, to maintain the imaging quality, the printing dot size, and the like, attention must be paid that the a certain amount of energy per printing dot is input onto the location of the printing dot on the surface during the exposure time in order that the interaction of the imaging beam with the surface of the printing form produces the desired (preferably the same) effect as in the case of the longer imaging with n concurrent beams. This is achieved according to the present invention by varying the imaging intensity of the imaging beam or laser diode as a function of the exposure time and the energy to be input.

The required imaging intensity to be used can depend both linearly and nonlinearly on the exposure time and/or on the amount of energy to be input per printing dot. The relationship depends, in particular, on the material or on the structure of the printing form surface. A nonlinear variation is to be expected especially when the exposure times are in the range of photothermal interaction, that is, in the millisecond or microsecond range. In contrast, a linear variation is expected if the exposure times are in the nanosecond range or shorter. It is known that threshold values for minimum energy flow or intensity of the imaging beams for achieving an imaging of a printing form surface decrease with decreasing exposure time (pulse length) and show a saturation behavior. This phenomenon is attributable, inter alia, to the heat transfer in the surface of the printing form. In this regard, see, for example, D. E. Hare et al. "Pulse Duration Dependence of Lithographic Printing Plate Imaging by Near-Infrared Lasers", Journal of Imaging Science and Technology, Vol. 42, No. 2, March/April 1998, p. 187–193, which is hereby incorporated by reference herein. In other words, the functional connection between the imaging intensity and the energy to be input must be known for different values of the parameter of exposure time (power-pulse time-energy characteristic map with corresponding projections of characteristic curves).

Therefore, the use of the method according to the present invention advantageously allows a printing form to be imaged with m imaging beams in the same time when compared to imaging with n>m imaging beams in spite of a failure of one or more imaging beams. The method according to the present invention can be advantageously used especially if the imaging intensity of the activatable laser diodes can be increased for a certain period of time without the risk of a high failure rate. Since the rate increases with the length of the period, use is advantageous especially for a short period of time: The method can be used in a temporary emergency strategy when an imaging device having failed imaging beams continues in use for imaging until the required spare part, the laser diode bar, the imaging device, or the like is delivered to the operator and installed. A decrease in productivity is reduced or even completely avoided. A service job to install the spare part becomes plannable.

The functional connection of the imaging intensity with the exposure time and the amount of energy to be input, which is required for the method according to the present invention for imaging a printing form, is stored in a storage device for the imaging device. Storage can be in the form of one or more calibration tables (a characteristics map, or characteristic curves). Possible is an at least partially analytical representation (equation) in the form of a calculation rule or an assignment rule using interpolation from tabulated points.

It is particularly advantageous if the method according to the present invention for imaging a printing form is iterated in the sense in which, in order to image r*m printing dots, r imaging steps are carried out in which m printing dots are placed on the printing form at a time, a relative movement between the imaging device and the printing form being carried out between each of the imaging steps. In other words, the method according to the present invention can be advantageously used for imaging a printing form with n-times parallelization.

In a preferred embodiment of the method according to the present invention for imaging a printing form, the distance of neighboring imaging spots a is k-times the minimum printing dot spacing p, with k and the number m of activatable laser diodes being relatively prime. In this context, k is preferably a prime number, that is, from the set {2, 3, 5, 7, 11, 13, 17, . . . }. That means that the imaging spots of the laser diodes do not lie densely together on the printing form. "Densely" means for imaging spots or printing dots that they have a minimum printing dot spacing p relative to each other. A typical imaging has a resolution of 2540 dpi, for example, the printing dots have a size of 10 micrometers, which is then also the typical distance of printing dots which lie densely to each other, or a resolution of 2400 dpi. Due to this, a particularly large number of possible m, which are generally greater than k, are relatively prime to k. It is clear that relative primeness is achieved especially if both m and k are prime numbers that are different from each other. Especially for the implementation of a nonredundant interleaving method, in particular as described in greater detail above, for imaging, it is advantageous if the feed in the direction of the setting line between two imaging steps for a number of m printing dots having an equal distance a amounts to m times the minimum printing dot spacing p.

The method according to the present invention can be carried out especially advantageously using one or more imaging devices which are assigned to a printing form mounted on a rotatable printing form cylinder. It is particularly convenient if the setting line is oriented essentially parallel to the cylinder axis and that the movement of the imaging beams relative to the printing form is carried out also with a further motion component in the circumferential direction of the cylinder perpendicular to the setting line by rotation of the printing form cylinder, with a feed parallel to the setting line that is equal to m times the printing dot spacing p in the direction of the setting line being reached exactly when the printing form cylinder has completed one full revolution. In other words, the imaging spots of the imaging beams are guided along helical parallel paths around the peripheral surface of the cylinder. Along the setting line, at a specific azimuth angle of the cylinders, the helices then appear to be interleaved so that, when projected to the setting line, one can speak of an interleaving method. However, it should be emphasized at this point, that in reality only m or, when using a number b of imaging devices, only (bm) parallel helices are written which just image the two-dimensional surface of the printing form to be imaged.

The method according to the present invention for imaging a printing form on a printing form cylinder can advantageously be used in a printing form imaging unit or a printing unit of a printing press. Especially for imaging devices in printing units, it applies that laser diode bars can only be replaced with increased effort. In this context, the printing press can be a web-fed or sheet-fed press. The printing method with which the printing press works preferably a direct or indirect planographic printing method, an offset printing method, or a flexographic printing method. Typical printing substrates are paper, cardboard, paperboard, or organic polymer material. A printing press can also have a plurality of such printing units featuring imaging devices in which a method according to the present invention for imaging a printing form is carried out.

The increase of the relative speed between the imaging device and the printing form by the factor f (f>1, f is an element of the set of real numbers, f≦n), preferably by the factor (n/m) or by a real number approximately equal to (n/m) in the method according to the present invention can be practically achieved by increasing the rotational speed of the printing form cylinder. At this point, it should be mentioned that for achieving as short as possible an imaging time for a number of n laser diodes with a given laser power which determines the imaging intensity, the rotational speed of the printing form cylinder is selected as high as possible under the condition that the amount of energy applied to the material of the printing form surface is sufficient to image the printing form and to ensure a sufficient service life of the printing form during printing. The highest possible rotational speed of the printing form cylinder can be determined under these conditions as a function of the laser power with the aid of imaging and print tests. When plotting these variables against each other, a power-pulse time characteristic is obtained for the material of the printing form surface used.

The method according to the present invention for imaging a printing form can also be used for imaging using a number b of imaging devices, each containing a laser diode bar having a number n of individually controllable laser diodes, the imaging spots of the activated laser diodes of the number b of imaging devices lying essentially in a row on the printing form, for the case that at least one laser diode on one of the b laser diode bars cannot be activated and that all laser diode bars have a number m of activatable laser diodes whose neighboring imaging spots on the printing form have a distance a, the imaging being accomplished by carrying out steps of the above-described method for imaging according to the present invention, the imaging being carried out using each of the number b of imaging devices having m activatable laser diodes whose neighboring imaging spots on the printing form have the distance a. The method can be advantageously used especially if each of the b imaging devices is assigned an area of the printing form surface, and if the b areas are imaged concurrently. By choosing the same number m for each of the b areas, it is guaranteed that the same imaging time, which determines the imaging time for the total surface to be imaged, is needed for all areas. The areas constitute mutually disjoint sets of printing dots on the surface.

The printing dots in an area can lie densely together, that is, all printing dots except for the edge dots have neighboring dots which also belong to this area. However, in particular for interleaving methods, the areas can also be non-simply connected, that is, in each area there exists at least one printing dot which is not an edge dot and which has a neighboring dot that lies in a different area: In an interleaving method with n imaging beams, as described above, an end region is produced in which a pattern of already placed printing dots and of printing dots that have not yet been placed is replicated with each iteration of the concurrent placement of n imaging beams. The complementary pattern, that is, the inverted pattern of printing dots that have not yet been placed and of already placed printing dots is just the pattern of the starting region of the interleaving method with n imaging beams. Thus, the starting region and the end region complement one another, resulting in printing dots that are placed densely together. Therefore, it is advantageous for a second region of the first area and a first region of the second area to be interleaved with each other, that is, to provide a transition region between a first region of the first area and the second of the second area in which are written the end region of the imaging device assigned to the first area and the starting region of the imaging device assigned to the second area. Extension to a number b of imaging devices with up to (b−1) transition regions is clear from this description for two imaging devices.

In a printing press having a plurality of printing units which have imaging devices associated therewith, the method for imaging according to the present invention can be carried out, for example, only with the imaging devices in a printing unit which is affected by a failure while in the other printing units, imaging is carried out with (bn)-fold parallelization. In each printing unit, different inoperabilities can be taken into account. In all printing units, the same imaging time is needed for an equal total surface to be imaged.

It should further be noted that, the data to be written must possibly be resorted as a function of the feed used in the method according to the present invention and of the used imaging beams, taking into account the reduced number m of imaging beams in comparison to the sequence of data in the case of n imaging beams, in order that the printing dot to be written that corresponds to the data is placed at the assigned coordinate on the printing form exactly at the time when the associated imaging beam passes over the assigned coordinate.

Also connected with the present invention is an imaging device for printing unit according to the present invention which contains at least one laser diode bar which has a number n of individually controllable laser diodes. The laser diodes can each be assigned to an imaging channel. The imaging device according to the present invention includes a control unit containing a computing device in which a program is executed which has at least one section in which a calculation of the imaging parameters required for the individual method steps, as described in greater detail above, in particular a calculation of the imaging intensity, is carried out as a function of the result of function testing devices of the laser diodes, such as measuring devices for the laser diodes on the diode laser bar.

Optionally, the control unit can be connected to the machine control. The control unit has connections, possibly via the machine control, to the actuating mechanism for producing the relative movement between the printing form and the imaging device. In this context, a resorting of the data for the imaging can be carried out in the control unit and/or in an upstream data processing unit as a function of the available number of activatable laser diodes.

The imaging device according to the present invention can be used especially advantageously in a printing form imaging unit or in a printing unit of a printing press. A printing press according to the present invention, which features one or more inventive printing units can be a web-fed or sheet-fed press. The underlying printing method of the inventive printing unit or of the inventive printing press can be a direct or indirect planographic printing method, a flexographic printing method, an offset printing method, or the like.

BRIEF DESCRIPTION OF THE DRAWINGS

Further advantages as well as expedient embodiments and refinements of the present invention will be depicted with reference to the following Figures and the descriptions thereof. Specifically.

DETAILED DESCRIPTION

Figure 1:
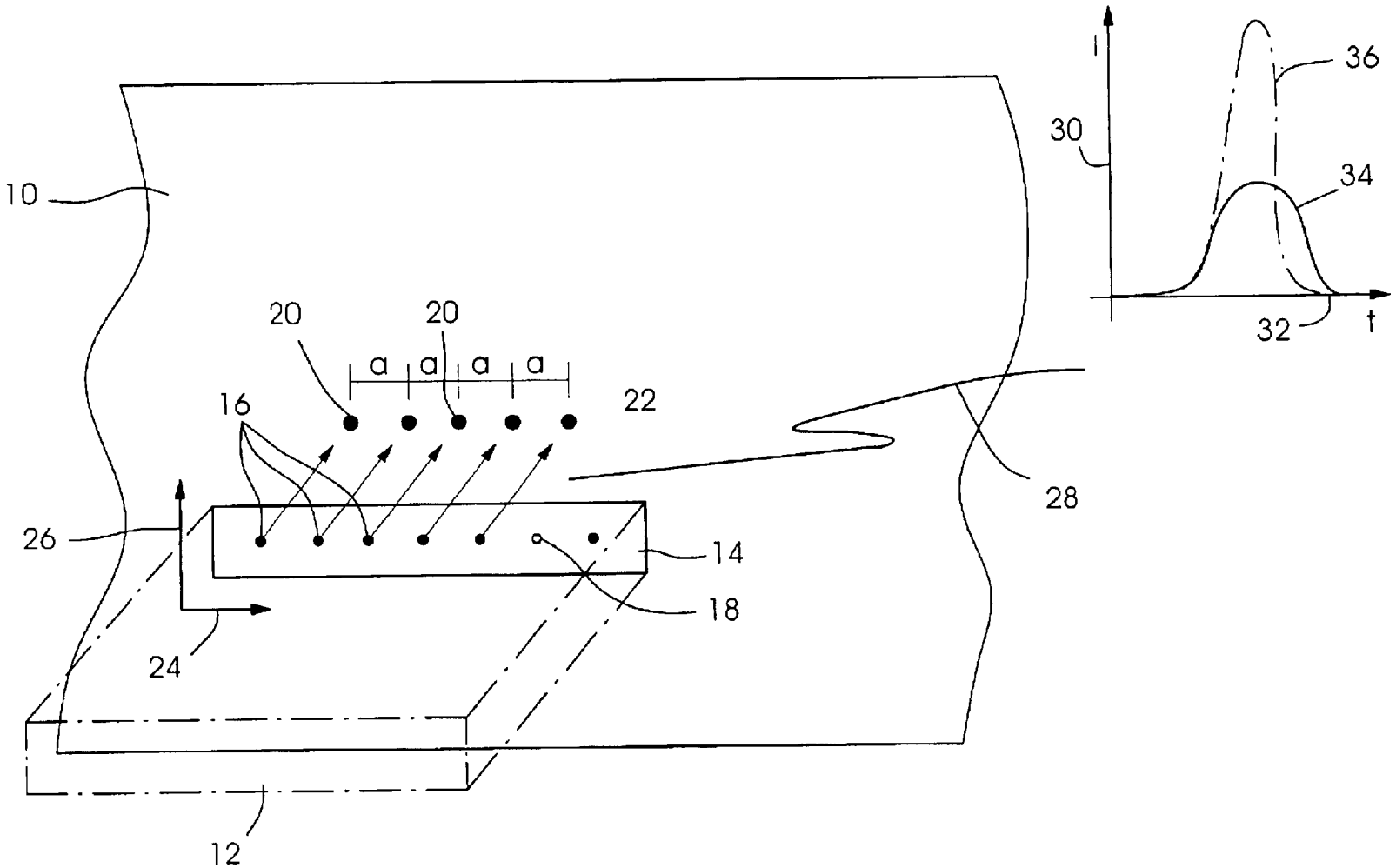
FIG. 1 is a schematic representation of the position of imaging spots which are produced by a laser diode bar on the surface of a printing form, including a graphical representation to illustrate intensity profiles of imaging beams over time.

FIG. 1 is a schematic representation of the position of imaging spots which are produced by a laser diode bar on the surface of a printing form, including a graphical representation to illustrate intensity profiles of imaging beams over time. Initially looking at the left half of FIG. 1, an imaging device 12 containing a laser diode bar 14 is assigned to a printing form 10 of which only a portion is shown here. A laser diode bar 14 having seven (here the number n) equally spaced laser diodes 16 located essentially in a row is shown here by way of example. In practice, a typical value for the number n of laser diodes 16 on a bar lies in the interval

[1,256], preferably in the interval [30,130], for example, n is 32, 64, or 128, or a prime number from said interval [1,256]. The light of activated laser diodes 16 is transferred to the printing form either directly or via suitable imaging optics, possibly with a magnification or reduction factor and optical elements for correcting imaging defects, such as astigmatism. As an illustrative example, FIG. 1 shows the situation that sixth laser diode 18, as counted from the left, cannot be activated. Therefore, imaging can be carried out using the first five laser diodes 16, as counted from the left (number m), using the method according to the present invention. On the printing form, there are shown five imaging sports 20 at locations where printing dots can be produced by imaging beams 22 originating from laser diodes 16. Neighboring imaging spots 20 have a distance a from each other. The imaging spots are equally spaced and lie essentially, preferably exactly, in a row in the direction of setting line 24. Relative to the direction of setting line 24, there is a further linearly independent direction 26 preferably running perpendicular to the setting line 24, these two directions defining the two-dimensional surface of the printing form. In the direction of setting line 24, i.e., in the direction of the position of the row of imaging spots 20, the imaging device can be advanced in such a manner that printing dots are placed in an interleaving method if distance a is a multiple of the minimum printing dot spacing p.

The right half of FIG. 1 shows a an exemplary time pattern 28 of an imaging beam 22 in the form of a graphical representation of the imaging intensity I, plotted in the direction of intensity axis 30, as a function of time t, plotted in the direction of time axis 32, for a qualitative discussion. Typical intensity profiles can have a Gaussian shape or be stepped. A first exemplary intensity profile 34, which increases from zero to a maximum and then decreases to zero again, represents the situation that the printing form is imaged with n-fold parallelization. A second exemplary intensity profile 36, which increases from zero to a maximum and then decreases to zero again, represents the situation that the printing form is imaged with m-fold parallelization, with m being smaller than n. When qualitatively comparing both intensity profiles 34, 36, it can be established that second intensity profile 36 reaches a higher maximum faster than first intensity profile 34 and also decreases faster to zero again (shortening of the exposure time according to the present invention). According to the present invention, the imaging intensity is increased for shorter exposure times, as explained above with respect to the amount of energy to be input per printing dot. Since, as already mentioned above, threshold values for minimum energy flow or intensity of the imaging beams for achieving an imaging of a printing form surface decrease with decreasing exposure time (pulse length) and show a saturation behavior for short pulse lengths, the integral $\int dt I(t)$ of second intensity shape 36 will be smaller than (for relatively long pulses) or essentially equal to (for relatively short pulses) the integral of the first intensity profile. This integral (dimension $J/m^2$) is a measure for the amount of energy input of the printing dot placed by imaging beam 22 at the location of imaging spot 20. Given a known pulse shape, a predetermined exposure time, and an energy input per printing dot selected as desired, the maximum intensity of the pulse can be determined by calculation. According to the present invention, the energy input is to be selected such that when working with the predetermined exposure time for m-fold parallelization, which is shortened compared to the n-fold parallelization, the same effect is achieved on the printing form.

In connection with this description, it should also be stressed that the shortening of the exposure time per printing dot is always limited by the maximum imaging intensity of laser diode 16. A typical laser diode can be destroyed when working with excessive pump powers, the pump power and the optical output power being generally proportional to each other. Should the shortening of the exposure time according to procedure of the present invention result in an imaging intensity which is greater than the maximum imaging intensity, then the inventive method is modified by carrying out the imaging with the maximum possible imaging intensity and the correspondingly minimum possible exposure time, i.e., as intensively as possible and as short as possible.

Figure 2:
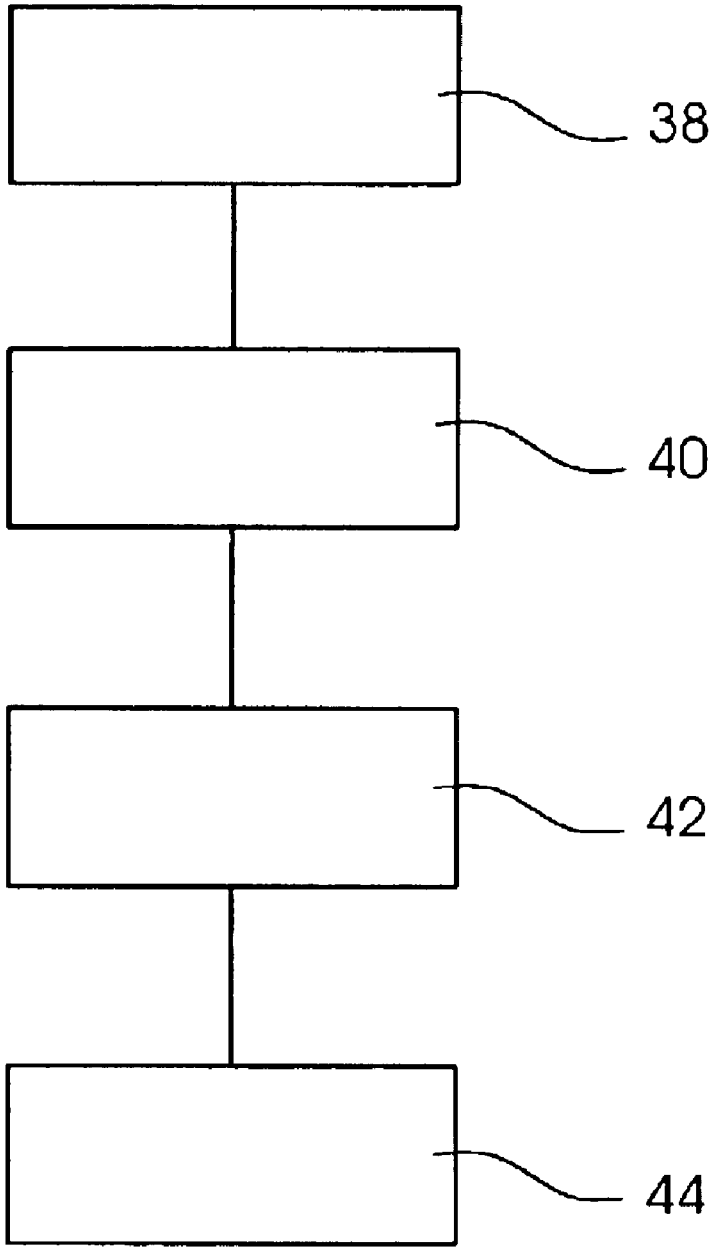
FIG. 2 shows a sequence flow chart of steps of the method according to the present invention.

FIG. 2 is a sequence flow chart of steps of the method according to the present invention. In a first step 38, the maximum number m of activatable laser diodes on the laser diode bar of the imaging device is determined, the distance a of neighboring imaging spots of the activatable laser diodes being equal. Typically, laser diode bars have a device for the functional testing of the individual laser diodes. Therefore, it is possible to test and determine the maximum number m inside the control unit of the imaging device, and to use this information for processing or appropriately sorting the data to be imaged. In a second step 40, the relative speed between the imaging device and the printing form is increased by a factor f on the basis of the determined number m. Embodiments of printing forms having imaging devices associated therewith feature one or more drives to the control unit of which is transmitted at least one signal for increasing the speed by the factor f. In third step 42, the exposure time per printing dot is reduced by the reciprocal factor 1/f. In other words, the imaging beams dwell on a particular location of the printing form surface only for a time which is shortened by the factor 1/f, because the passage was speeded up by increasing the relative speed so that only this shortened time is available for an exposure. In a fourth step 44, the m activatable laser diodes are used to concurrently input an amount of energy per printing dot on the printing form with a corresponding imaging intensity which is dependent on the exposure time and on the respective amount of energy per printing dot. Fourth step 44 can be iterated or repeated, in particular to place printing dots at different locations of the printing form surface in an interleaving method.

Figure 3:
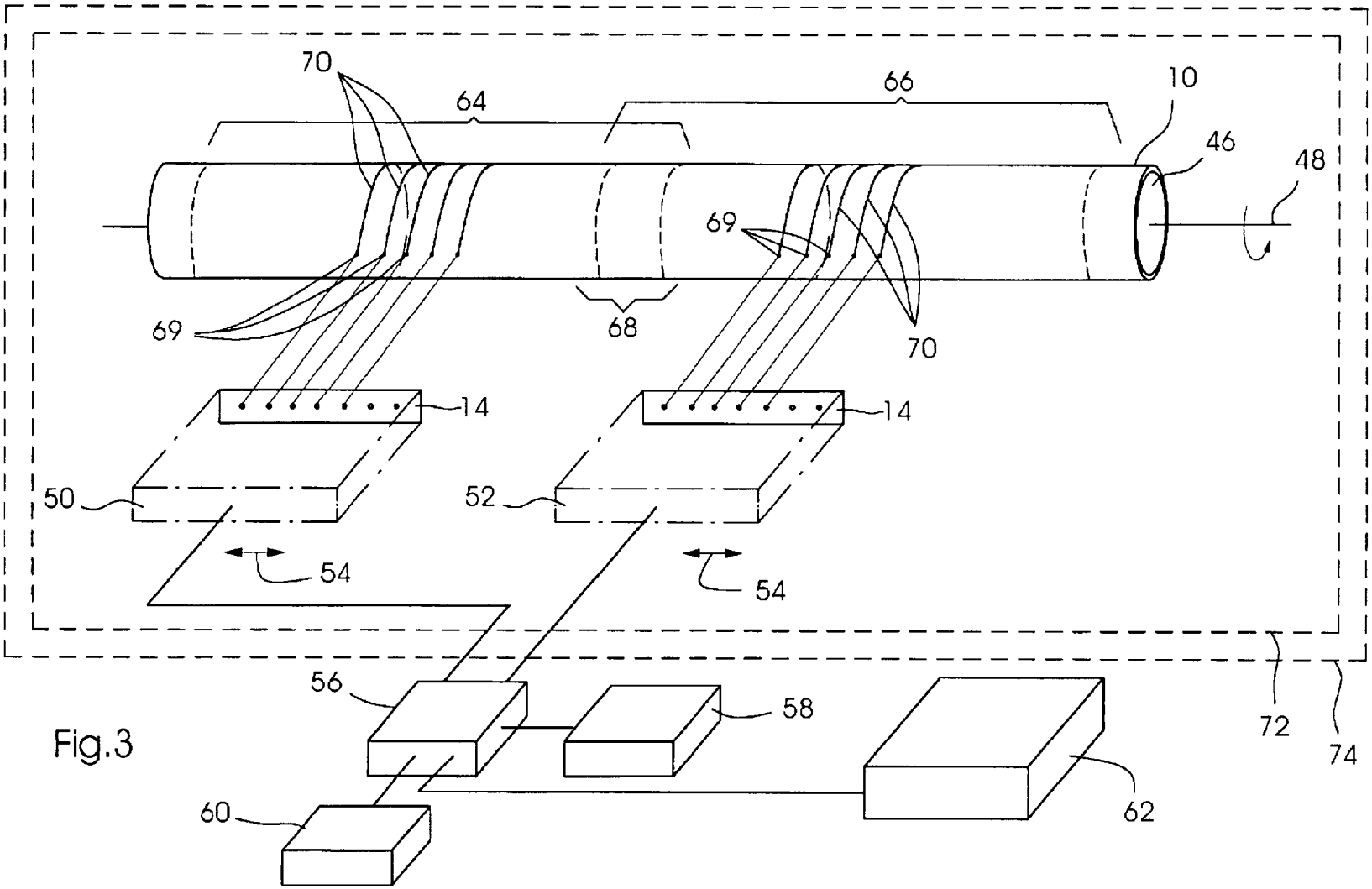
FIG. 3 shows an advantageous embodiment of two imaging devices which allow a printing form mounted on a cylinder in a printing unit to be imaged according to the present invention.

FIG. 3 relates to an advantageous embodiment of two imaging devices which allow a printing form mounted on a cylinder in a printing unit to be imaged according to the present invention. Printing form 10 is mounted on a printing form cylinder 46 which is rotatable about its cylinder axis 48 by a drive which is not specifically shown here. A first imaging device 50 and a second imaging device 52 are movable in a direction of translation 54 relative to the surface of printing form 10 essentially parallel, preferably parallel to cylinder axis 48. First imaging device 50 and second imaging device 52 can also be movable relative to each other, that is, their distance can be variable. A common imaging of a printing form 10 is accomplished by the concurrent use of the imaging devices 50, 52 in that first imaging device 50 images a first area 64 of the total surface to be imaged and second imaging device 52 images a second area 66 of the total surface to be imaged, the complement of the first region 64. Moreover, as explained in greater detail above, depending on the passage of the imaging devices over the surface, in particular in interleaving methods, a transition region 68 can exist in which first and second areas 64, 66 are interleaved. Printing dots 69 of first and second areas 64, 66 form mutually disjoint subsets of the set of all printing dots to be placed. The subsets can lie on the printing form in a connected manner (all printing dots 69 lying densely together) or in a non-connected manner (at least one printing dot 69 does not lie densely to the other printing dots of the subset, that is, for example, one printing dot 69 having only neighboring printing dots from the complement, transition region 68).

The imaging spots of imaging beams 22 of first and second imaging devices 50, 52 pass over the surface of printing form 10 on helical paths 70 in such a manner that printing dots 69 can be placed close together, generally according to an interleaving method as described above, in particular, a non-redundant interleaving method. Following the example used earlier, it is assumed that at least one laser diode has failed on first and second imaging devices 50, 52 so that imaging can only be carried out with m-fold parallelization instead of with n-fold parallelization. To this end, it is possible to use the method according to the present invention.

For simplicity of explanation, it is also assumed here by way of example that each of imaging devices 50, 52 is able to write with five imaging beams. Printing dots 69 placed by said laser diodes then lie on helical paths 70 of the imaging spots on printing form 10. When looking at a specific azimuth angle and a specific height along cylinder axis 48 on printing form 10, then printing dots are placed on a specific helical path 70 at a first time while neighboring close-lying printing dots lie on other helical paths 70. In other words, helical paths 70 of the imaging beams are interleaved.

First and second imaging devices 50, 52 are connected to control unit 56 of the imaging device. Control unit 56, which is used, in particular, for controlling the laser diodes on the basis of the subject to be imaged, is connected to a storage device 58, which can also be integrated into control unit 56. The functional connection of the imaging intensity with the exposure time and the amount of energy to be input is stored for the imagine device in storage device 58, for example, in the form of a calibration table. Alternatively to the connection of the imaging intensity with the exposure time, that is, the effect on printing form 10, the functional connection can also be, on one hand, the connection between the power output of laser diode 16 and the exposure time or, on the other hand, the connection between the pump power of laser diode 16 and the exposure time.

At this point, it should also be mentioned that the calibrated connection possibly needs to be recalibrated because of the aging of the laser diodes or other processes having similar effects. Using the stored functional connection, it is possible to determine a pump power for laser diode 16. The individual laser diodes 16 on laser diode bar 14 can be provided with measuring devices, for example, in the form of a photodiode behind a resonator mirror of each laser diode 16, which are used for measuring the optical output power of laser diode 16. At a certain pump power, the measured optical output power will deviate from the optical output power required to achieve the desired effect on printing form 10 by a certain imaging intensity, because the aging process especially affects the connection between the pump power and the optical output power. Using a controller, the pump power can be varied until the optical output power meets the required level.

Imaging with a specific maximum exposure time per printing dot and a specific rotational speed can be carried out in accordance with the situation by taking the corresponding value according to the functional connection. Control unit 58 is further provided with a power supply device 60 which supplies the power required for imaging.

In other words, first imaging device 50 and second imaging device 52 are associated with a control unit 56 to which they are also connected when moving in direction of translation 54. Control unit 56 contains a computing device in which a program is executed which has at least one section for carrying out the inventive method described above, also when working with the refinements thereof. Control unit 56 is operatively connected to machine control 62. Not specifically shown in FIG. 3 are the actuating mechanism, the drives for rotating printing form cylinder 46, and the translation of imaging devices 50, 52. This actuating mechanism can be controlled by control unit 56 in open and/or closed loop.

Printing form cylinder 46 can be accommodated in a printing unit 72 of a printing press 74. Control unit 56 can be connected to machine control 62, allowing easy coordination of the translational motion and rotational motion and, in particular, easy information exchange with respect to the rotational speed and the feed speed of imaging devices 50, 52 upon determination of the parameter of the number m of activatable laser diodes whose imaging spots have an equal distance a, number m being reduced compared to the n-fold parallelization.

In the event that there is a number of laser diodes which cannot be activated, an advantageous refinement makes provision for the control unit to automatically emit a message or note to the machine operator, for example, in the form of audible and/or visual signals. It can also be advantageous for the control unit to send an electronic message directly to a computer of the machine service center or to immediately establish a connection to a computer of the machine service center, in order that the service center can be directly provided with the information on a required replacement of the laser diode bar, and that immediate action can be taken without avoidable delay.

Lying in a row as defined herein means lying essentially in a row.

LIST OF REFERENCE NUMERALS

10 printing form
12 imaging device
14 laser diode bar
16 laser diode
18 non-activatable laser diode
20 imaging spots
22 imaging beam
24 setting line
26 linearly independent direction with respect to the setting line
28 time pattern of an imaging beam
30 intensity axis
32 time axis
34 first intensity profile
36 second intensity profile
38 determination of activatable laser diodes
40 increasing the relative speed
42 shortening the exposure time
44 imaging
46 printing form cylinder
48 cylinder axis
50 first imaging device
52 second imaging device
54 direction of translation
56 control unit
58 storage device
60 power supply device

62 machine control
64 first region of the first area
66 second region of the second area
68 transition region between first and second areas
69 printing dot
70 helical paths of the imaging spots
72 printing unit of a printing press
74 printing press
a distance
I intensity
t time

What is claimed is:

1. A method for imaging a printing form using an imaging device containing a laser diode bar having a number n of individually controllable laser diodes, imaging spots of activated laser diodes from the n laser diodes lying in a row on the printing form, at least one laser diode on the laser diode bar not capable of being activated so that the laser diode bar has a maximum number m of activatable laser diodes of the n laser diodes with neighboring imaging spots on the printing form having a distance a, the method comprising the steps of:

increasing a relative speed between the imaging device and the printing form by a factor f, where $f>1$ and $f \leqq n$ and f is a real number;

shortening an exposure time per printing dot by the factor 1/f; and imaging using the m activatable laser diodes to input in each case an amount of energy per printing dot on the printing form with an imaging intensity, the imaging intensity being a function of the exposure time and of the amount of energy per printing dot.

2. The method for imaging a printing form as recited in claim 1 wherein the factor f equals n divided by m.

3. The method for imaging a printing form as recited in claim 1 wherein a functional relationship of the imaging intensity to the exposure time and the amount of energy to be input is stored for the imaging device in a storage device.

4. The method for imaging a printing form as recited in claim 1 wherein the method is iterated so that in order to image r*m printing dots, r imaging steps are carried out, in each of the r imaging steps m printing dots being placed on the printing form at a time, a relative movement between the imaging device and the printing form being carried out between each of the r imaging steps.

5. The method for imaging a printing form as recited in claim 1 wherein the distance a of the neighboring imaging spots is k times a minimum printing dot spacing p, k and the number m of activatable laser diodes being relatively prime.

6. The method as recited in claim 5 wherein k is a prime number.

7. The method for imaging a printing form as recited in claim 5 wherein a feed in the direction of a setting line between two imaging steps being m times the minimum printing dot spacing p.

8. The method for imaging a printing form as recited in claim 1 wherein the printing form is mounted on a rotatable printing form cylinder having a cylinder axis and wherein a setting line is oriented parallel to the cylinder axis; and a movement of imaging beams from the laser diodes relative to the printing form is carried out also with a further motion component in a circumferential direction of the cylinder perpendicular to the setting line by rotation of the printing form cylinder, with a feed parallel to the setting line being equal to m times the printing dot spacing p in the direction of the setting line and being reached exactly when the printing form cylinder has completed one full revolution.

9. The method for imaging a printing form as recited in claim 8 wherein the printing form cylinder is accommodated in a printing unit of a printing press.

10. The method for imaging a printing form as recited in claim 8 wherein f equals n divided by m and for increasing the relative speed between the imaging device and the printing form by the factor f, a rotational speed of the printing form cylinder is increased.

11. A method for imaging a printing form using a number b of imaging devices, each imaging device containing a laser diode bar having a number n of individually controllable laser diodes, imaging spots of activated laser diodes of the number b of imaging devices lying in a row on the printing form, at least one laser diode on one of the b laser diode bars not capable of being activated, all laser diode bars having a number m of activatable laser diodes with neighboring imaging spots on the printing form having the distance a, the method comprising the step of:

imaging the printing form according to the method recited in claim 1 using each of the b imaging devices with the m activatable laser diodes.

12. The method as recited in claim 11 wherein each of the b imaging devices is assigned an area of the printing form surface, the b areas being imaged concurrently.

13. An imaging device for a printing form comprising:

at least one laser diode bar having a number n of individually controllable laser diodes, imaging spots of activated laser diodes of the n laser diodes lying in a row on the printing form, the laser diode bar having a maximum number m of activatable laser diodes having neighboring imaging spots on the printing form having a distance a, and a control unit including a computing device having executable program steps executing the following steps:

increasing a relative speed between the imaging device and the printing form by a factor f, where $f>1$ and $f \leqq n$ and f is a real number;

shortening an exposure time per printing dot by the factor 1/f, and imaging using the m activatable laser diodes to input in each case an amount of energy per printing dot on the printing form with an imaging intensity, the imaging intensity being a function of the exposure time and of the amount of energy per printing dot.

14. A printing unit comprising:

at least one imaging device as recited in claim 13.

15. A printing press comprising:

at least one printing unit as recited in claim 14.

* * * * *